US007229325B1

(12) United States Patent
Flynn et al.

(10) Patent No.: US 7,229,325 B1
(45) Date of Patent: Jun. 12, 2007

(54) SUBMERSIBLE ELECTRICAL CONNECTOR

(75) Inventors: Jeffrey T. Flynn, Cincinnati, OH (US); William E. Smith, Cincinnati, OH (US); Bill Wolins, Cincinnati, OH (US)

(73) Assignee: Ilsco Corporation, Cincinnati, OH (US)

( * ) Notice: Subject to any disclaimer, the term of this patent is extended or adjusted under 35 U.S.C. 154(b) by 0 days.

(21) Appl. No.: 11/192,564

(22) Filed: Jul. 29, 2005

(51) Int. Cl.
*H01R 4/36* (2006.01)

(52) U.S. Cl. ..... 439/814; 439/798

(58) Field of Classification Search ..... 439/814, 439/810, 798, 589
See application file for complete search history.

(56) References Cited

U.S. PATENT DOCUMENTS

| | | | | |
|---|---|---|---|---|
| 3,395,382 | A | 7/1968 | Weagant | |
| 3,519,981 | A | 7/1970 | Koletsos et al. | |
| 3,522,575 | A * | 8/1970 | Johnson et al. | 439/281 |
| 3,557,299 | A | 1/1971 | Dienes | |
| 3,643,208 | A | 2/1972 | Massa, Jr. | |
| 3,710,003 | A | 1/1973 | Channell | |
| 3,740,692 | A | 6/1973 | Filhaber | |
| 3,848,074 | A | 11/1974 | Channell | |
| 3,877,772 | A * | 4/1975 | De Cenzo | 439/839 |
| 4,276,523 | A | 6/1981 | Boutros et al. | |
| 4,711,509 | A | 12/1987 | Cross et al. | |
| 4,737,600 | A | 4/1988 | Mathis et al. | |
| 4,768,970 | A | 9/1988 | Nestor | |
| 4,832,616 | A | 5/1989 | Stein, Sr. et al. | |
| 5,055,636 | A | 10/1991 | Jaycox | |
| 5,059,748 | A | 10/1991 | Allen et al. | |
| 5,235,134 | A | 8/1993 | Jaycox | |
| 5,267,880 | A | 12/1993 | Tamm | |

(Continued)

OTHER PUBLICATIONS

CMC/ESP Utility Products, *Underground Connector*, Product Bulletin, Oct. 2004.

(Continued)

*Primary Examiner*—Neil Abrams
*Assistant Examiner*—Phuongchi Nguyen
(74) *Attorney, Agent, or Firm*—Wood, Herron & Evans, LLP

(57) ABSTRACT

A submersible electrical connector intended for use in a power distribution network permits a metal to stripped metal conductor connection to be visually inspected and verified by the installer while eliminating many opportunities for human error present with existing connectors. The connector in one embodiment includes a generally cup or dome-shaped enclosure which is preferably transparent. An open end of the enclosure mates with a seal body and a connector plate has a number of apertures adapted to receive the bare metal ends of conductors or wires inserted through the seal body. Each aperture in the connector has an associated set screw for securing the conductor thereto. A molded seal member is adapted to mate with the seal body and to provide a water-tight connection when mated with the enclosure. The seal member has a number of seal ducts each aligned with one of the apertures in the connector. The seal ducts provide a water-tight seal around the plastic sheath of the conductor when installed in the assembly. Each seal duct initially includes a missel-shaped wire way guide plug inserted therein. Each wire way guide plug is open at the bottom to receive the exposed end of the conductor therein. The wire way guide plugs remain installed in the seal ducts to seal them until a conductor is inserted through the associated seal duct.

34 Claims, 9 Drawing Sheets

U.S. PATENT DOCUMENTS

| | | | |
|---|---|---|---|
| 5,308,923 | A | 5/1994 | Puigcerver et al. |
| 5,408,743 | A | 4/1995 | Tournier et al. |
| 5,496,968 | A | 3/1996 | Katoh et al. |
| 5,533,912 | A | 7/1996 | Fillinger et al. |
| 5,589,666 | A | 12/1996 | DeCarlo et al. |
| 5,618,206 | A | 4/1997 | Sawada et al. |
| 5,639,992 | A | 6/1997 | Debbaut |
| 5,667,413 | A | 9/1997 | Trafton |
| 5,720,629 | A | 2/1998 | Self, Jr. et al. |
| 5,727,314 | A | 3/1998 | Ashcraft |
| 5,848,913 | A | 12/1998 | Ashcraft |
| 6,329,601 | B1 | 12/2001 | Bulford |
| 6,352,450 | B1 | 3/2002 | Bronk et al. |
| 6,375,519 | B1 * | 4/2002 | Liang ..... 439/762 |
| 6,641,444 | B2 | 11/2003 | Hanazaki et al. |
| 6,688,921 | B2 | 2/2004 | Borgstrom et al. |
| 6,716,063 | B1 | 4/2004 | Bryant et al. |
| 6,764,354 | B2 | 7/2004 | Kaine et al. |
| 6,793,530 | B2 | 9/2004 | Walse |
| 6,817,910 | B2 | 11/2004 | Borgstrom et al. |
| 6,854,996 | B2 | 2/2005 | Yaworski et al. |
| 6,863,544 | B2 | 3/2005 | Haehn et al. |
| 7,056,151 | B2 | 6/2006 | Cawood et al. |
| 2004/0157488 | A1 | 8/2004 | Yaworski et al. |
| 2004/0161968 | A1 | 8/2004 | Cawood et al. |

OTHER PUBLICATIONS

CMC/ESP Utility Products, *Underground Connectors*, Mar. 2003.
The Homac Companies, "*Flood-Seal" Double 4/O Mechanical Connector Series*, p. 31.
The Homac Companies, *The First Pedestal Connectors Designed Exclusively for URD*, p. 25.
The Homac Companies, "*Flood-Seal" Pipe/Conduit Sealers*, p. 44.
Thomas & Betts Corporation, *Submersible Bus Connectors*, p. C-3.
The Homac Companies, *Sweetheart "Flood Seal" Mechanical Connectors*, p. 30.

* cited by examiner

SUBMERSIBLE ELECTRICAL CONNECTOR

FIELD OF THE INVENTION

This invention relates to the general field of electrical connectors and is particularly concerned with a submersible, set-screw type, electrical connector.

BACKGROUND OF THE INVENTION

Electrical distribution systems are used extensively in most industrialized countries. These distribution systems typically include power cables, transformers and connectors for linking the components together. Some distribution systems have cables suspended from poles anchored into the ground so that the cables are located substantially above the ground surface. In such instances, the transformers and connectors are also mounted on the poles above the ground.

Newer electrical distribution today is underground. This includes not only the conductor but the transformer and the set screw connector. The connections are usually made below grade in a hand hole, manhole, vault or fairly deep hole with confined space. Many such connections are made in mud or muddy water. If the connection is not below water initially, over its service life, it will be due to rains or floods or even normal seasonal fluctuations of ground water.

To provide such connectors with a longer service life, submersible connectors have been developed. Such connectors are provided with a molded waterproof encasement. Problems, however, arise both where the conductors enter the case and more particularly where access to the set screw is required.

Many such connectors include long projecting sleeves at the conductor ports which are plugged with elongated grommets known as "rockets." The rockets include stepped tips which are cut off at a selected step depending on the size of the conductor. The conductor is inserted through the cut-off tip of the rocket which now becomes an elongated sleeve grommet. Both are inserted into the long sleeve of the case with the grommet sealing against the interior of the sleeve and the projecting tip of the conductor extending beneath the path of the set screw. The preparation and insertion of the conductor is typically a two-handed operation for a technician.

Access to the set screw is through a port provided by a somewhat shorter cylindrical sleeve projection. The port is provided with a removable cap or plug which is supposed to provide a watertight connection. When the plug is removed, access is provided to the recessed hex head set screw.

The submersible connection in each of the paired sleeve ports includes the rocket and the watertight plug. When the connection is initially installed, only some of the paired ports may be used and additional connections may be made later, if ever.

When a connection is made, the rocket is removed, cut to size and inserted on the end of the conductor. Before inserting the conductor, the technician has to remove the plug on the corresponding set screw port sleeve projection and make sure the set screw is backed out. This is done by inserting a hex driver such as an Allen wrench and backing out the set screw. Only then is the conductor inserted to a position to be clamped by the set screw. Because of the tight connection of the plug in its sleeve, such plugs usually have to be removed with a pair of pliers. The set screw is then tightened with the hex driver to complete the electrical connection. While the modified rocket seals the conductor port, the plug has to be replaced and properly seated to maintain the waterproof integrity of the case. The technician must perform all of these operations usually with heavy gloves on, and in a cramped dark, and wet space. It is not uncommon for the bottom of the space to be filled with muddy water.

Since the technician often wears gloves, manual dexterity is compromised and the plug or rocket is often dropped. Commonly, after the connection is made, the technician must grope in the mud or water to retrieve the plug or rocket.

If the plug can not be found readily, the common practice is to cover the port hole with a strip or strips of electrical tape, for a makeshift seal, if a seal at all. One major cause of failure of this type of connector is the loss of watertight rockets and plugs. The absence of a proper plug and a properly sized rocket allows water to penetrate the connector.

Unfortunately, water ingress, particularly where the plug and rocket is intended to seal against the jacket of the conductor end, may result in corrosion and failure of the connector. When properly installed, such plugs and rockets do not permit water ingress. Unfortunately, if improperly installed the seal provided by the plug and rocket may not be sufficient to keep water out. Accordingly, water enters and degrades the electrical connection resulting in premature failure of the connector. The inability to easily inspect the connectors in underground hand holes or vaults is also problematic, especially in light of the opportunity for errors in making the connections.

Less highly skilled technicians are more commonly used to install the connectors as a cost savings measure for utilities and their subcontractors. Instances of improper installation are more likely to occur as training and skill levels are reduced, and while at the same time greater production rates are required. For example, an improperly trained technician may cut the rocket at a ring that is too large to correctly seal on the conductor. Of course, the larger the ring, the less insertion force required to position the conductor through the rocket. Weeks, months or years after installation, water penetrates the area of the "seal" and causes connector failure.

Therefore, a submersible electrical set screw connector which could more easily be used and properly installed with less chance for human error in the cramped and wet environment of an underground connection is needed. The ability to easily and readily inspect the connection is also highly desired. Moreover, such a connector where components such as the rockets or plugs would not get lost and would remain handy to the technician to properly and efficiently complete a long lasting failure free set screw connection is also desired.

Another problem associated with known electrical connectors of this type stems from the use of conductors having a number of strands encased in a plastic sheath. Whether the conductors are manufactured as segmented or non-segmented center conductors from aluminum wire strands or copper wire strands, the end portion of the sheath must be removed from the conductor to expose the wire strands for electrical connection. The technician then inserts the unsheathed tip end of the conductor into the aperture in the set screw connector. In many instances, numerous strands of the conductor splay outwardly from the remaining strands as the unsheathed end of the conductor is inserted through various holes, ports or apertures in such submersible and allegedly water-tight connection systems. Such frayed conductors with splayed strands are much more difficult for the technician to efficiently and cleanly insert into the connector to accomplish a proper connection.

Moreover, proper installation of the conductors should avoid splaying the conductor strands. Additionally, the design should allow for a variety of sizes of conductors and tap lines to be accommodated with a minimum of installation effort and without specialized tools. The connector must be designed so that taps can be made by tap lines and conductors added and withdrawn after the original installation.

SUMMARY OF THE INVENTION

This invention solves these and other problems with known submersible electrical connectors. The invention is a submersible electrical tap system intended for use in a power distribution network primarily by electric utility companies. The invention permits a metal to stripped metal conductor connection to be visually inspected and verified by the technician while eliminating many opportunities for human error present with existing connectors.

The electrical connector includes a generally cup or dome-shaped enclosure which is preferably transparent and has an open end opposite from a closed end. The open end includes a peripheral skirt and internal threads which are adapted to mate with outwardly directed threads on a seal body insertable into the enclosure. The seal body has a number of upwardly projecting posts, preferably four in number, spaced around the periphery of the seal body. The posts are adapted to releasably support a metal connector plate mounted thereon. The connector plate has a number of apertures adapted to receive the bare metal ends of conductors or wires inserted through the seal body. Each aperture in the connector has an associated set screw for securing the conductor thereto.

The invention also includes a molded seal member adapted to mate with the seal body and to provide a water-tight connection when the seal body and seal member are mated with the enclosure. The seal member has a number of upwardly directed, nipple-shaped seal ducts each aligned with one of the apertures in the connector plate when mounted in the enclosure. The seal ducts provide a water-tight seal around the plastic sheath of a conductor when installed in the assembly without the need for cutting or modification by the technician.

Each seal duct initially includes a missel-shaped wire way guide plug inserted therein. Each wire way guide plug is open at the bottom to receive the exposed end of the conductor therein. The wire way guide plugs remain installed in the seal ducts to seal them until a conductor is inserted through the associated seal duct. The exposed metal end of the conductor is inserted into the open bottom of the wire way guide plug and the wire way guide plug is pushed through the seal duct by the conductor.

The wire way guide plug performs many functions in the seal tap invention. In addition to sealing off the associated seal duct when a conductor is not present, the wire way guide plug also guides the exposed metal end of the conductor through the seal duct for connection with the connector and prevents the individual metal strands of the conductor from splaying outwardly while being inserted through the seal duct. Once the conductors are inserted through the seal duct, the associated wire way guide plug is removed from the conductor and discarded.

As such, the submersible electrical connector of this invention is significantly more easily utilized by a technician even in a cramped and wet environment of an underground hand hole or the like. The invention avoids the detailed and tedious cutting and sizing required to use rockets or comparable plugs to effect a water-tight electrical connection. Moreover, the electrical connector accommodates a wide variety of conductor sizes and the installation and assembly of the conductors and electrical connector is readily inspected through the clear dome-shaped enclosure. Moreover, the connection system can be modified at any subsequent time to add or withdraw conductors without sacrificing the integrity of the water-tight connection. Finally, the problems associated with splayed strands of a conductor inserted through various ports, apertures and ducts is overcome with the wire way guide plug included in this invention.

BRIEF DESCRIPTION OF THE DRAWINGS

The objectives and features of the invention will become more readily apparent from the following detailed description taken in conjunction with the accompanying drawings in which.

DETAILED DESCRIPTION

Figure 1:
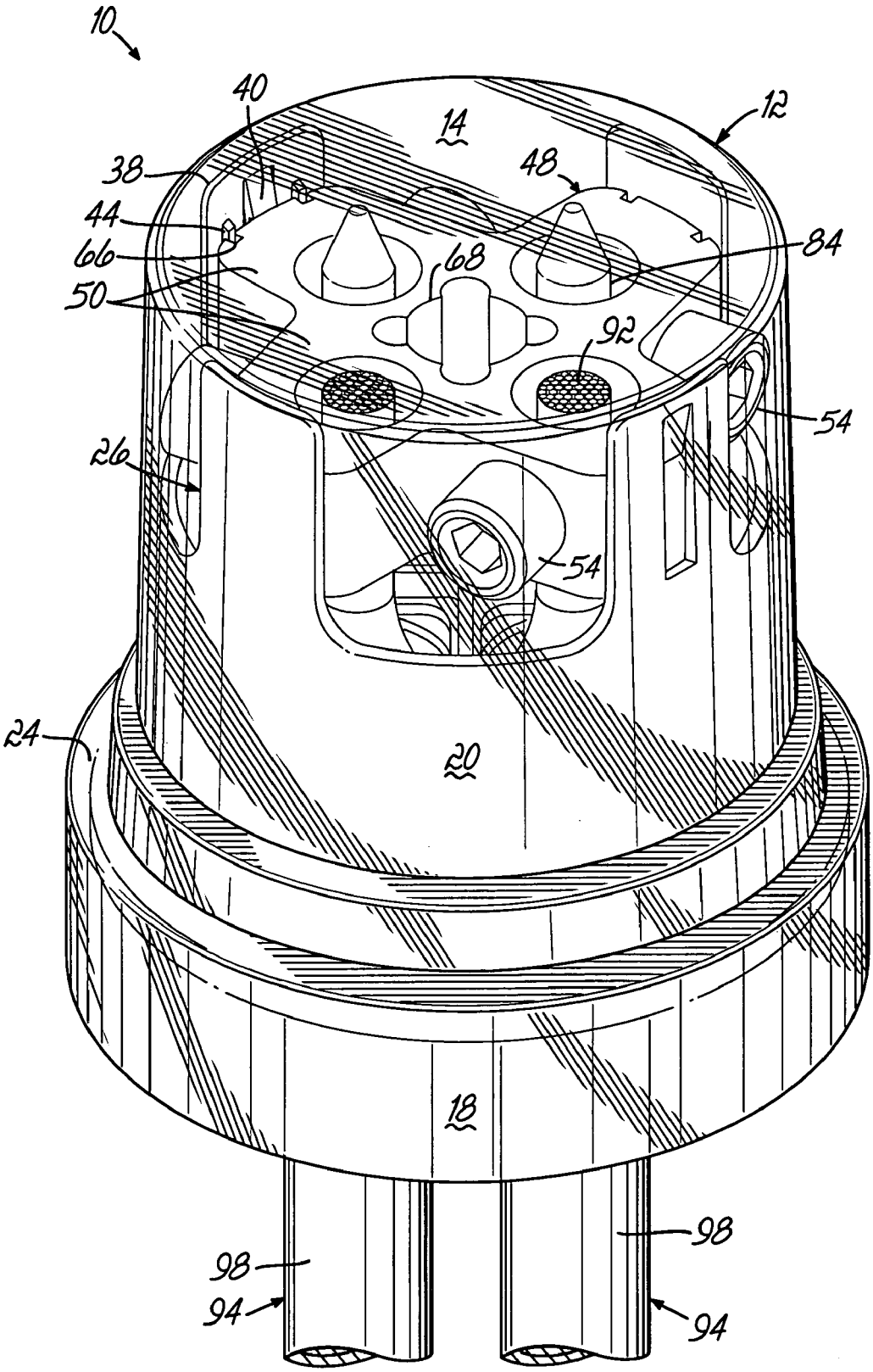
FIG. 1 is a perspective view of one embodiment of a submersible electrical connector according to this invention.
Figure 2:
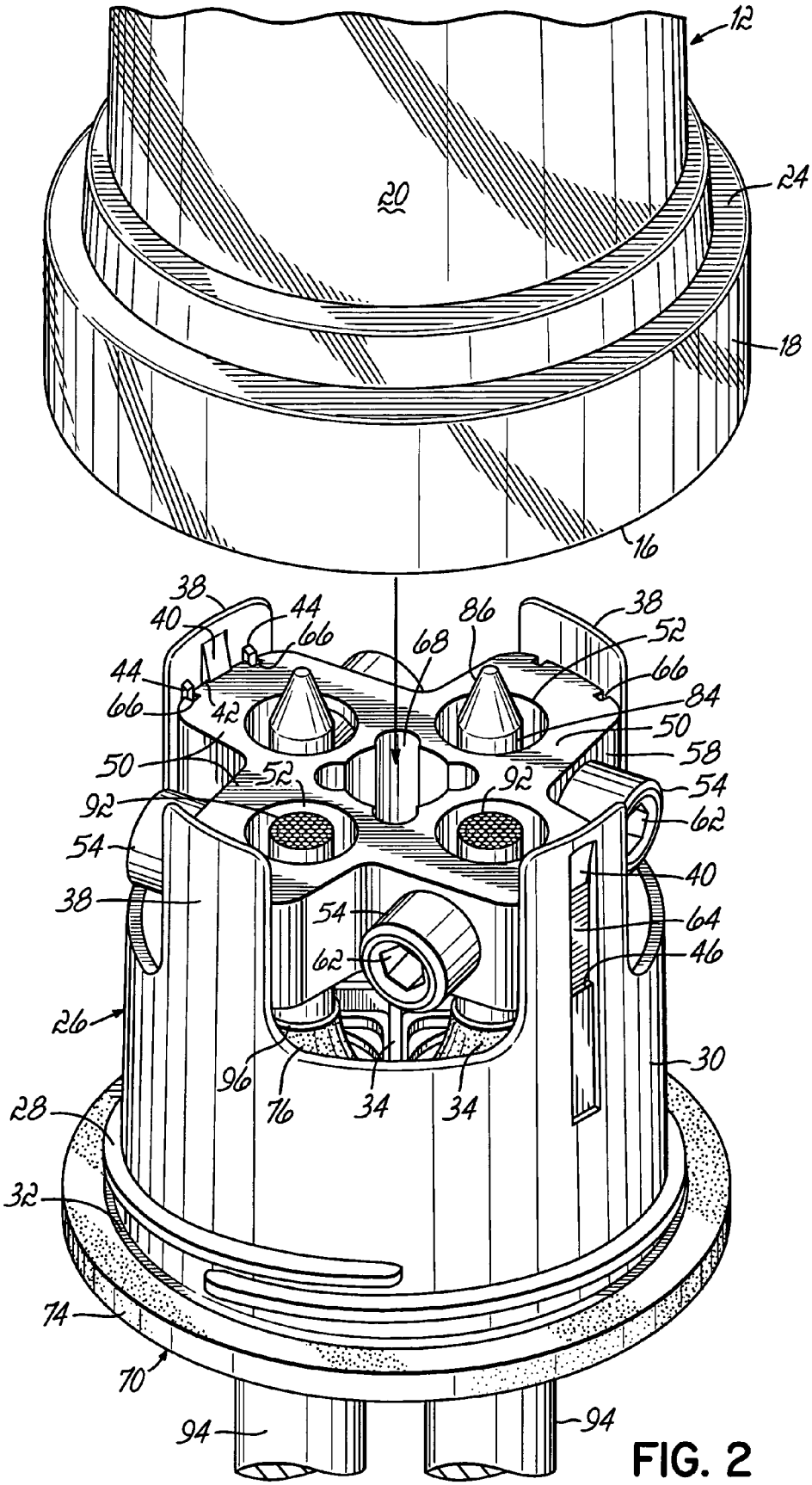
FIG. 2 is a view similar to FIG. 1 with a dome enclosure of the submersible electrical connector being installed.
Figure 2A:
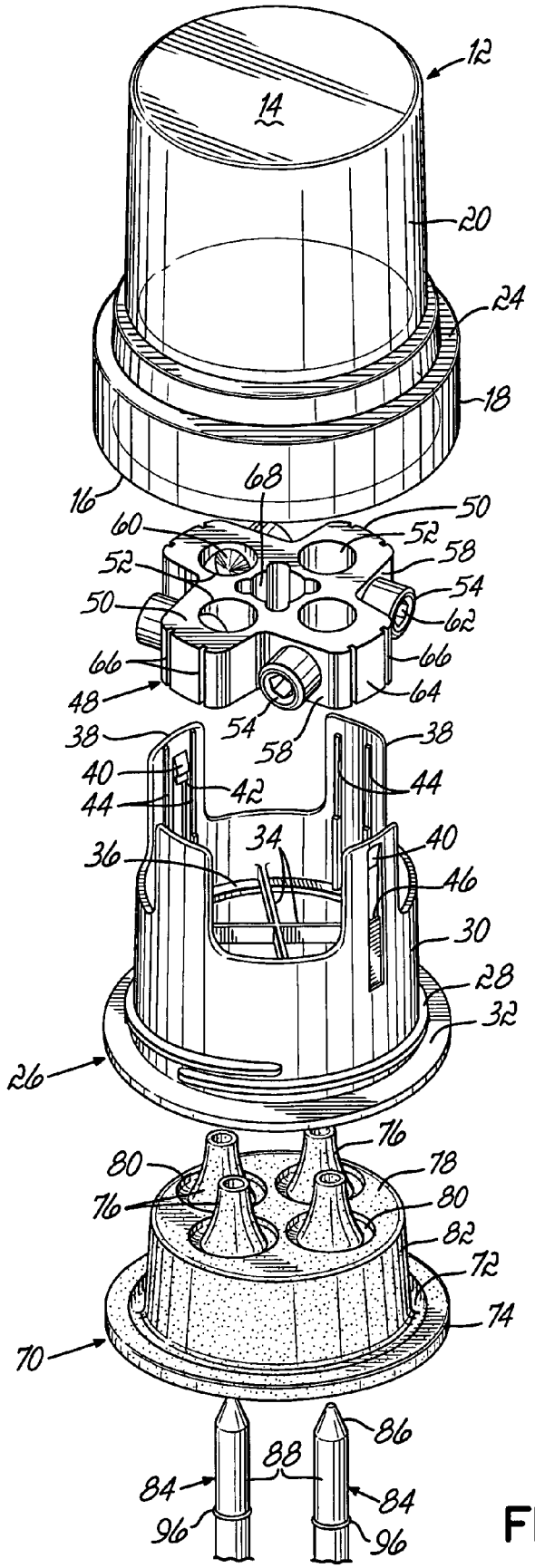
FIG. 2A is an exploded perspective view of the components of the submersible electrical connector of FIG. 1.
Figure 3A:
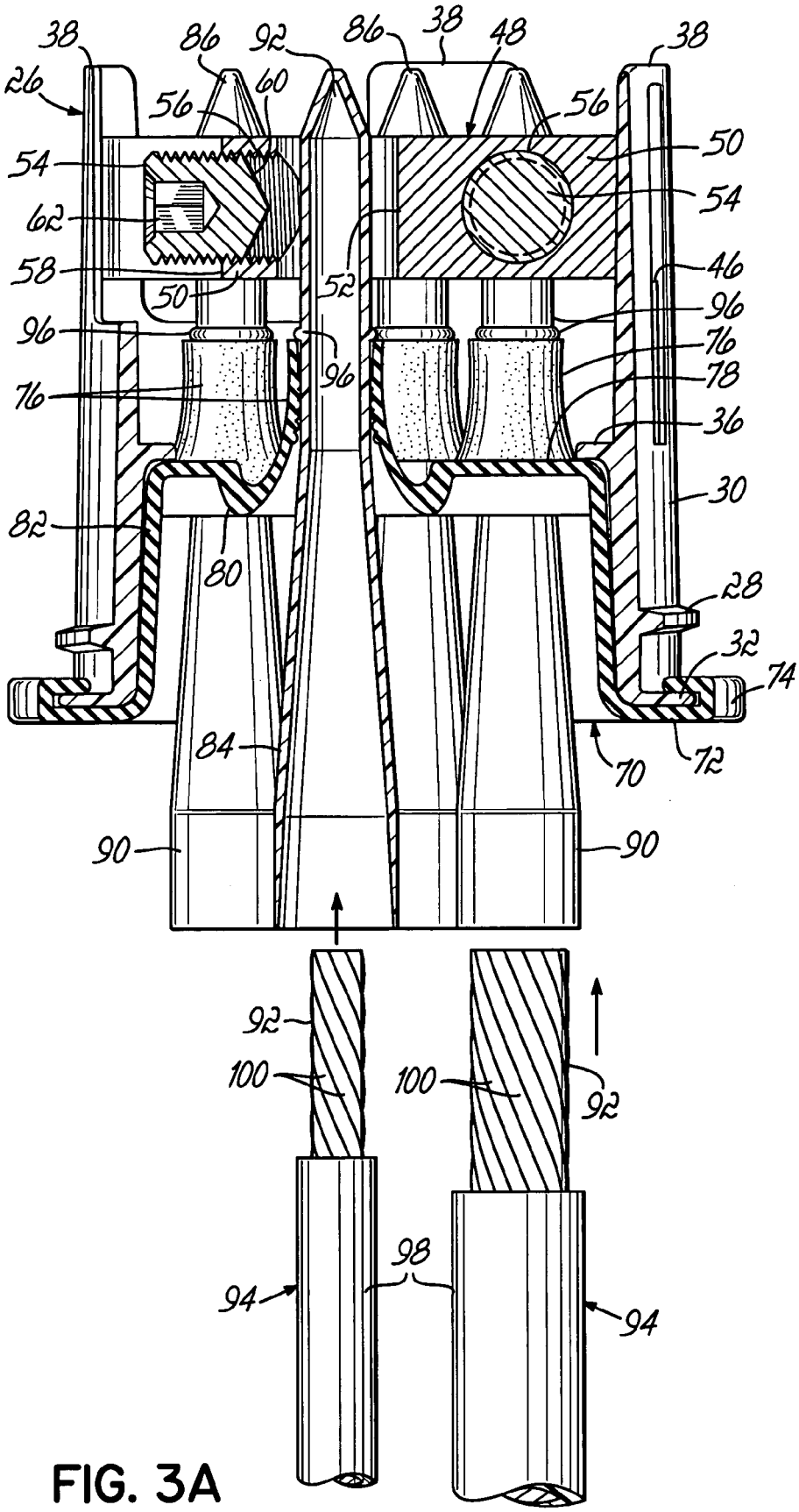
FIGS. 3A thru 3D are cross-sectional sequential views of a pair of conductors being inserted into and connected to the submersible electrical connector of FIG. 1.
Figure 3B:
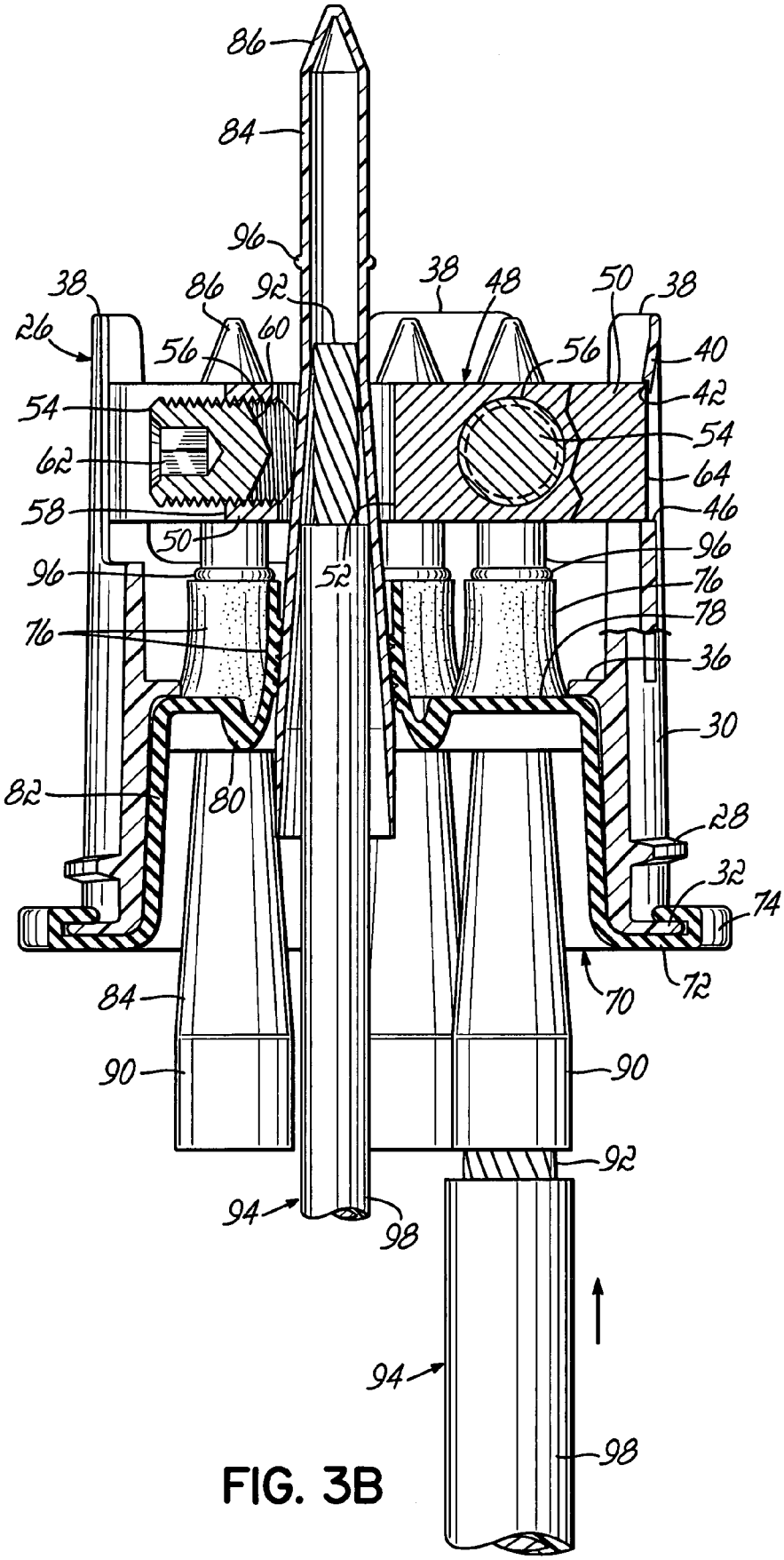
Figure 3C:
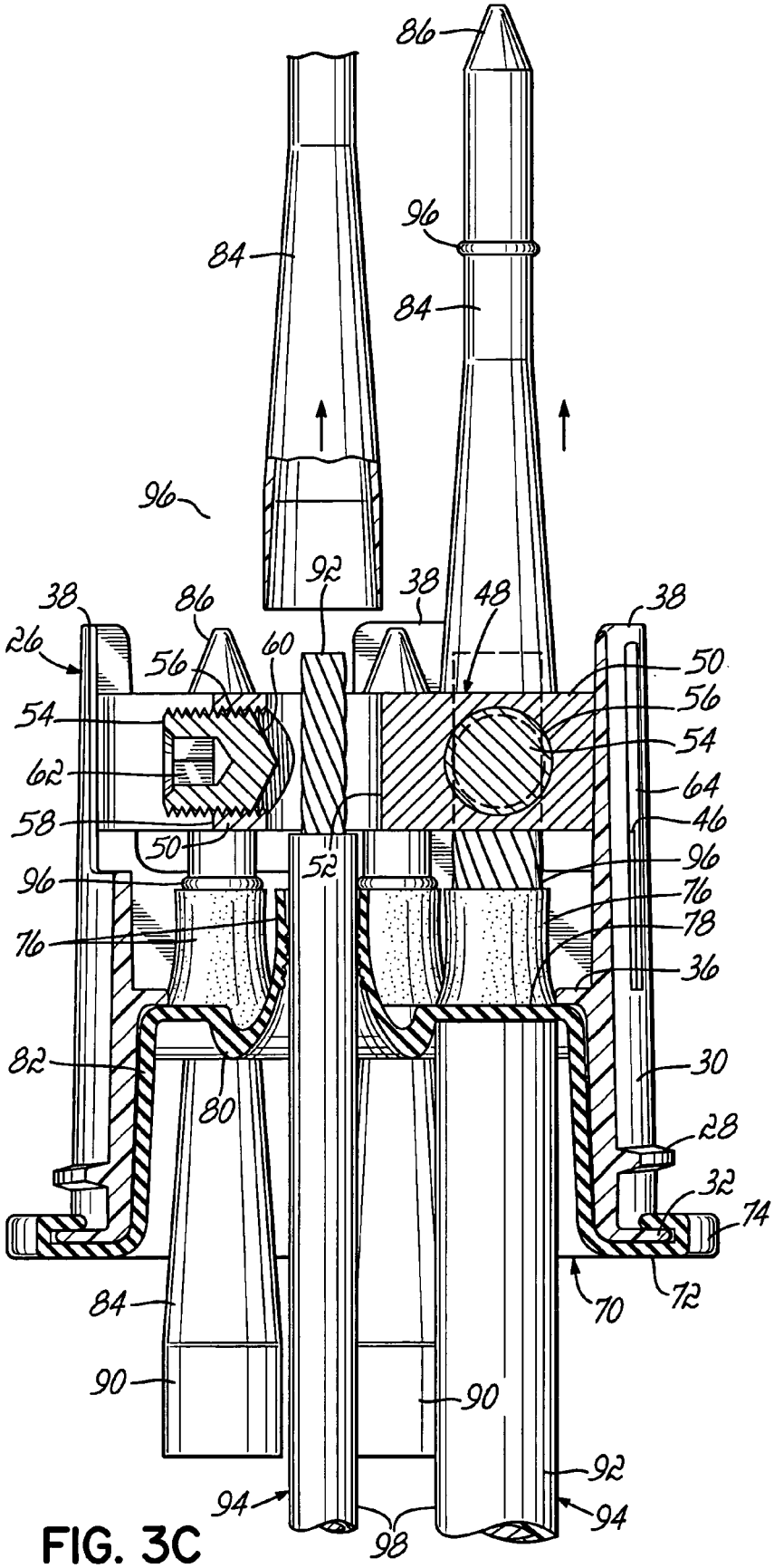
Figure 3D:
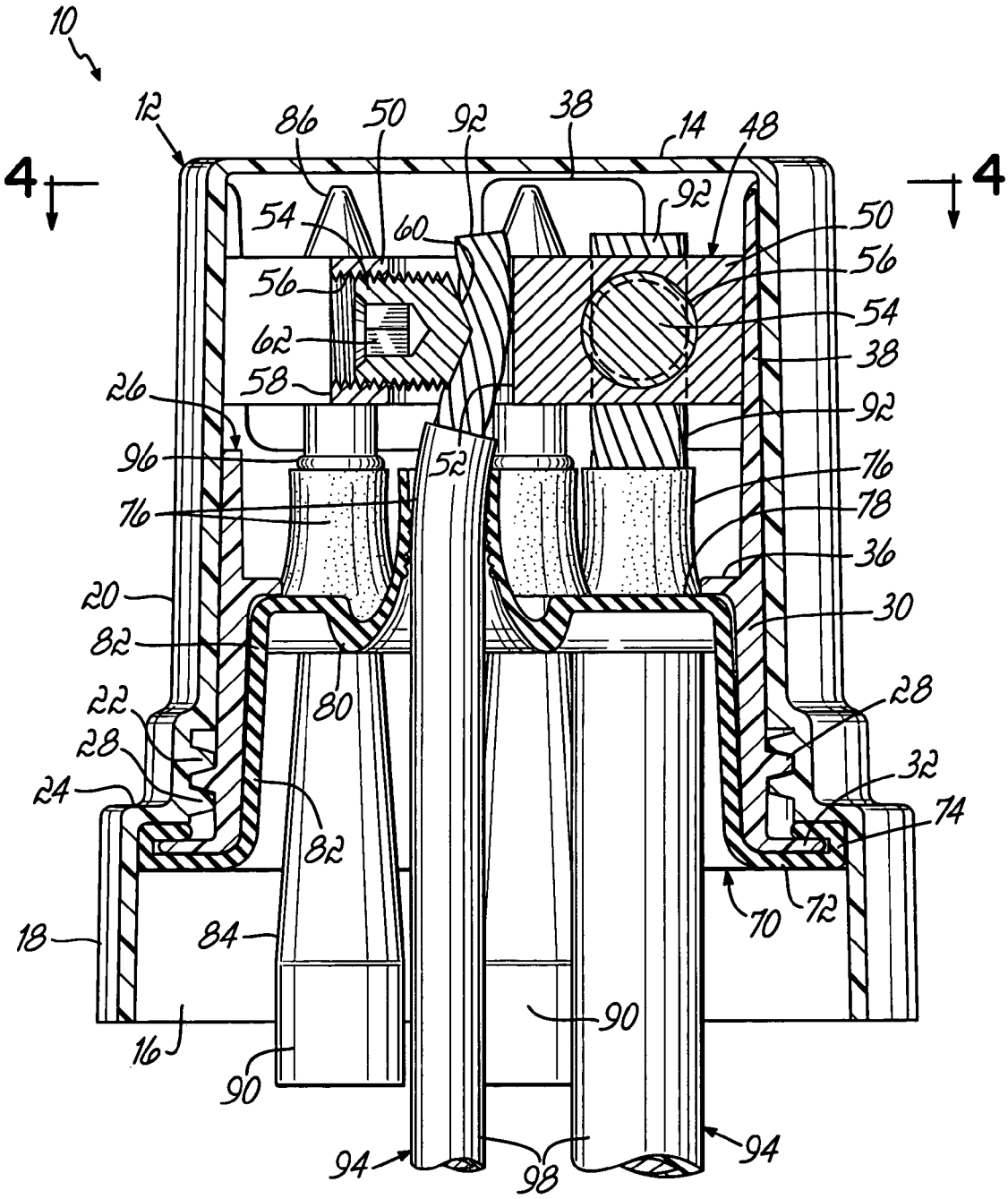
Figure 4:
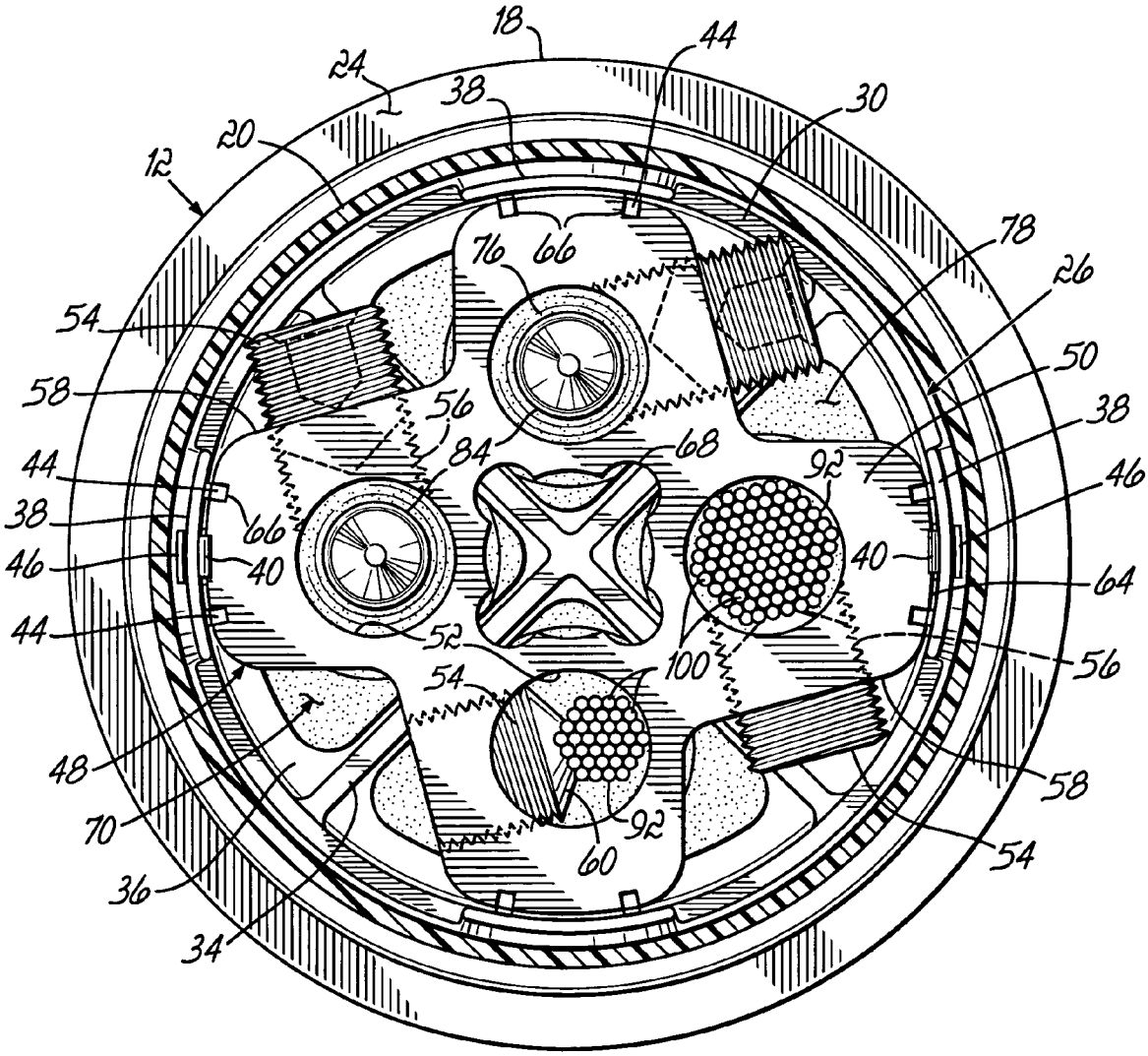
FIG. 4 is a cross-sectional view taken along line 4—4 of FIG. 3D.

One exemplary embodiment demonstrating the various features and aspects of an electrical connector assembly 10 according to this invention is shown in FIGS. 1–2A and the installation of conductors and assembly of the electrical connector is shown in FIGS. 3A–4.

The electrical connector assembly 10 of this invention includes a number of individual component parts and elements which will be described in detail with respect to FIGS. 1–2A. The electrical connector assembly 10 which is adapted to be submersible includes an enclosure 12 with a generally planar closed end 14 opposite from an open end 16 surrounded by a peripheral skirt 18. A generally cylindrical sidewall 20 of the enclosure 12 extends between the closed upper end 14 and the skirt 18. An internal thread 22 is provided on the interior surface of the enclosure 12 at a shoulder 24 positioned between the sidewall 20 and the skirt 18. In one embodiment, the enclosure 12 is manufactured from a transparent or translucent polycarbonate material which allows a technician to visually inspect the interior of the enclosure 12 and the electrical connections therein.

A seal body 26 is adapted to be inserted through the open end 16 of the enclosure 12 and includes a thread 28 adapted to engage the thread 22 on the enclosure 12 to releasably secure the components together. The seal body 26 includes a peripheral generally circular sidewall 30 with a lower flange 32 projecting generally perpendicular from the sidewall 30 around a bottom edge of the seal body 26. The sidewall 30 of the seal body 26 defines a generally tubular configuration with a pair of orthogonal intersecting ribs 34 extending from the interior of the sidewall 30. An interior rim 36 is also provided on the inner surface of the sidewall 30 as shown particularly in FIG. 2A. The ribs 34 and rim 36 are spaced from the lower flange 32 of the seal body 26.

The seal body 26 also includes a number of posts 38 projecting upwardly from an upper edge of the sidewall 30. Four such posts 38 are shown equally spaced at approximately 90° intervals in the attached figures, although it should be appreciated that the invention is not limited to any particular configuration or arrangement in this regard. The posts 38 are of equal height and one of them includes a downwardly directed bayonet spring detent 40 on an inner face of the post 38. As best shown in FIG. 3B, the bayonet detent 40 includes a notch 42 and the function of the notch 42 will be described in more detail later herein. A pair of inwardly projecting parallel keys 44 are spaced on the interior face of each post 38. Each of the keys 44 also includes an offset ridge 46 at a juncture between upper and lower portions of the keys 44. In one embodiment, the seal body 26 is a clear or transparent member permitting inspection by the technician.

The seal body 26 and associated posts 38 are adapted to support a connector plate 48. In one embodiment, the connector plate 48 of this invention has a generally non-circular, cruciform configuration in which four lobes 50 are equally spaced at 90° intervals. Each lobe 50 includes a generally circular aperture 52 extending axially through the connector plate 48. Each aperture 52 is in communication with a set screw 54 mounted in a threaded hole 56 extending between a sidewall 58 of the associated lobe 50 and the aperture 52. The set screw 54 includes a conical or pointed tip 60 projecting into the aperture 52 and a socket 62 at an opposite end adapted to receive an Allen wrench or other tool so that the set screw 54 may be rotated relative to the connector plate 48 to advance or retract the set screw 54 in the hole 56 and to/from the aperture 52. As shown more clearly in FIG. 4, the axis of the threaded hole 56 and associated set screw 54 is perpendicular to the angled sidewall 58 of the associated lobe 50. Since the sidewall 58 is angled relative to a diametrical axis of the connector plate 48, the set screw 54 can conveniently be retracted allowing for access to the associated aperture 52 while still providing for placement of the connector plate 48 within the enclosure 12.

Each lobe 50 of the connector plate 48 also includes an arcuate-faced end wall 64. A pair of spaced generally parallel keyways 66 are formed in the end wall 64 of each lobe 50. The keyways 66 are sized and configured to receive therein the keys 44 of one of the posts 38 on the seal body 26. Each of the lobes 50 of the connector plate 48 is aligned with one of the posts 38 on the seal body 26 and the connector plate 48 is lowered axially into the seal body 26 so that the keys 44 and keyways 66 of the associated lobe 50 and post 38 are aligned with one another. As the connector plate 48 is inserted into the seal body 26, the downwardly directed bayonet detent 40 deflects outwardly until an upper surface of the connector plate 48 passes the notch 42 of the bayonet detent 40 to clip the connector plate 48 in place in the seal body 26. The lower face of the connector plate 48 rests on the offset ridges 46 of the keys 44 to thereby capture the connector plate 48 in the seal body 26 and inhibit further axial movement when the components are assembled together. As best shown in FIG. 3B, the connector plate 48 may include a central cavity 68 to thereby minimize its weight and material. The connector plate 48 is preferably metal to provide for proper electrical interconnection with the conductors.

The submersible electrical connector assembly 10 according to one embodiment of this invention also includes a seal member 70. The seal member 70 includes a lower flange 72 with an inwardly directed U-shaped lip 74 around the perimeter of the flange 72. The seal member 70 also includes a number of upwardly directed nipple-shaped seal ducts 76, four of which are shown herein equally spaced at 90° intervals. The seal ducts 76 are arranged and configured to align with the apertures 52 in the connector plate 48 when the components of the electrical connector 10 are assembled together. Each seal duct 76 projects upwardly from an upper plateau surface 78 of the seal member 70 and is joined to the upper surface 78 of the seal member 70 by an annular pleat 80. The seal member 70 has an annual sidewall 82 between the flange 72 and the upper plateau surface 78.

The seal member 70 is adapted to mate with the seal body 26 such that the seal ducts 76 project upwardly between the ribs 34 of the seal body 26 and the sidewall 82 of the seal member 70 is inserted into the interior of the seal body 26. The internal rim 36 and ribs 34 of the seal body 26 are juxtaposed to the upper plateau surface 78 of the seal member 70 and the U-shaped lip 74 surrounding the seal member flange 72 is wrapped around the lower flange 32 of the seal body 26. The seal member 70 may be molded from Santoprene™, rubber, elastomers or other similar materials.

The submersible electrical connection system 10 in one aspect also includes a number of wire way guide plugs 84, each of which is sized and configured to be inserted into one of the seal ducts 76 and the associated aperture 52 in the connector plate 48. Each wire way guide plug 84 has a generally missel-shaped configuration with a conical blunt upper tip 86 and a outwardly flared body 88. Each wire way guide plug 84 has an open base go adapted to receive an end 92 of a conductor 94. The wire way guide plugs 84 are preferably molded plastic or similar material. Each wire way guide plug 84 includes a detent ring 96 spaced from the blunt tip 86. The detent ring 96 is sized and configured on the wire way guide plug 84 to be juxtaposed to the upper edge of the associated seal duct 76 when the wire way guide plug 84 is inserted through the seal member 70 as shown in FIG. 3A. The upper blunt tip 86 of the wire way guide plug 84 projects upwardly through one of the apertures 52 in the connector plate 48 and the set screw 54 may optionally be advanced to contact or secure the wire way guide plug 84.

The assembly and installation of the components of the submersible electrical connector 10 according to this invention and connection with conductors 94 will be described with particular reference to FIGS. 3A–3D. Prior to initial installation and assembly with conductors 94, the dome-shaped enclosure 12 is removed from the seal body 26, but the seal member 70 and seal body 26 are mated together with the seal member lip 74 engaged with the seal body flange 32 and the seal ducts 76 projecting upwardly through the ribs 34 of the seal body 26. Wire way guide plugs 84 are inserted into each of the seal ducts 76 as shown in FIG. 3A with the ring detent 96 juxtaposed to the upper edge of the associated seal duct 76. The metal connector plate 48 is mounted to the posts 38 of the seal body 26 with the keyways 66 and keys 44 of the respective lobes 50 and posts 38 interengaged.

Advantageously, the submersible electrical connector 10 can be provided from the vendor or manufacturer to the electric distribution company, utility or technician fully assembled including the wire way guide plugs 84 inserted into the seal ducts 76, the seal body 26 and seal member 70 mated together, the metal connector plate 48 mounted in the seal body 26 and the dome enclosure 12 threaded onto the seal body 26. The technician merely needs to remove the enclosure 12 from the remaining components to effect installation of the conductors 94. Another beneficial aspect of this invention is that the set screws 54 while installed in the threaded holes 56 of the associated lobe 50 can be provided and shipped in a retracted, backed-out position providing convenient access and installation for the conductors 94 without required adjustment by the technician to begin installation.

The wire way guide plugs 84 seal the associated seal duct 76 when installed therein as shown in FIG. 3A. Once the technician strips the terminal portion of a sheath 98 surrounding the conductor 94, an exposed end 92 of the conductor 94 is inserted into the open-ended base go of the selected wire way guide plug 84. The wire way guide plug 84 is tapered to accommodate a range of gauges or sizes of conductors 94. Additionally, the taper of the plug 84 allows for reasonable exertion force by the technician/installer for conductor 94 entry. The upper end 92 of the conductor 94 is pushed upwardly as shown in FIG. 3A into the wire way guide plug 84 until the conductor strands 100 are pinched by the reducing diameter of the wire way guide plug 84. Advantageously, the strands 100 of the conductor 94 are captured in the wire way guide plug 84 to prevent splaying and associated problems. The continued upward movement of the conductor 94 forces the wire way guide plug 84 through the seal duct 76 and aperture 52 of the metal connector plate 48 as shown in FIG. 3D. A silicone or other lubricant may be added to the exterior surface of the wire way guide plugs 84 to provide easier passage of the wire way guide plugs 84 through the seal ducts 76.

After the exposed end 92 of the conductor 94 is positioned in the aperture 52 of the metal connector plate 48, the technician pulls the wire way guide plug 84 off of the conductor 94 and entirely through the aperture 52 of the connector plate 48. Once the wire way guide plug 84 is dislodged from the conductor 94 and connector plate 48, it may be discarded. Alternatively, the plug 84 may be saved for reuse. The pleat 80 joining the seal duct 76 to the upper plateau surface 78 of the seal member 70 flexes to accommodate movement of the wire way guide plug 84 and conductor 94 while maintaining the seal duct 76 in sealed circumferential engagement with the wire way guide plug 84 or conductor 94 inserted there through. Depending on the number of conductors 94 to be connected to the metal connector plate 48, this procedure is repeated for each appropriate conductor 94 and wire way guide plug 84. The ring detent 96 and shape of the wire way guide plug 84 and seal duct 76 inhibit or prevent the retrograde movement of the wire way guide plug 84 through the bottom open end of the seal member 70. As such, the technician can only remove the wire way guide plug 84 in an upward direction as shown in FIGS. 3A through 3D thereby simplifying installation procedures avoiding potential installation errors.

As shown in FIGS. 3A–4, the electrical connector 10 of this invention accommodates a range of differing gauge or size conductors 94. As such, the technician does not need to calculate the diameter of the conductor 94 being installed and cut components based on that size for proper installation as in prior art connectors.

After the conductors 94 are inserted through the seal ducts 76 and the wire way guide plugs 84 for those conductors are removed, the appropriate set screws 54 are rotated and advanced to secure the conductors 94 to the metal connector plate 48 as shown in FIG. 3D. The seal ducts 76 form a seal around the sheath 98 of the conductor 94. If each of the apertures 52 in the metal connector plate 48 is not utilized, the associated wire way guide plugs 84 remain in the seal ducts 76 thereby allowing for future installation of conductors 94 in those locations while maintaining a sealed assembly until that time.

The next step in the installation and assembly procedure is to install the enclosure 12 onto the seal body 26 by threadably engaging the respective threads 22, 28. The seal body 26 is inserted into the open end 16 of the enclosure 12 the two members are rotated relative to one another to engage the respective threads 22, 28. Another very important benefit of the enclosure's open end 16 is that it limits strain on the conductors 94. The distance between the connector plate 48 and the open end 16 of the enclosure 12 provides strain relief. With the enclosure 12 threaded onto the seal body 26, the lower surface of the shoulder 24 adjacent the skirt 18 of the enclosure 12 compresses the uppermost portion of the U-shaped lip 74 on the seal member 70, thereby providing a fluid-tight seal around the entire circumference of the assembly 10.

Figure 5:
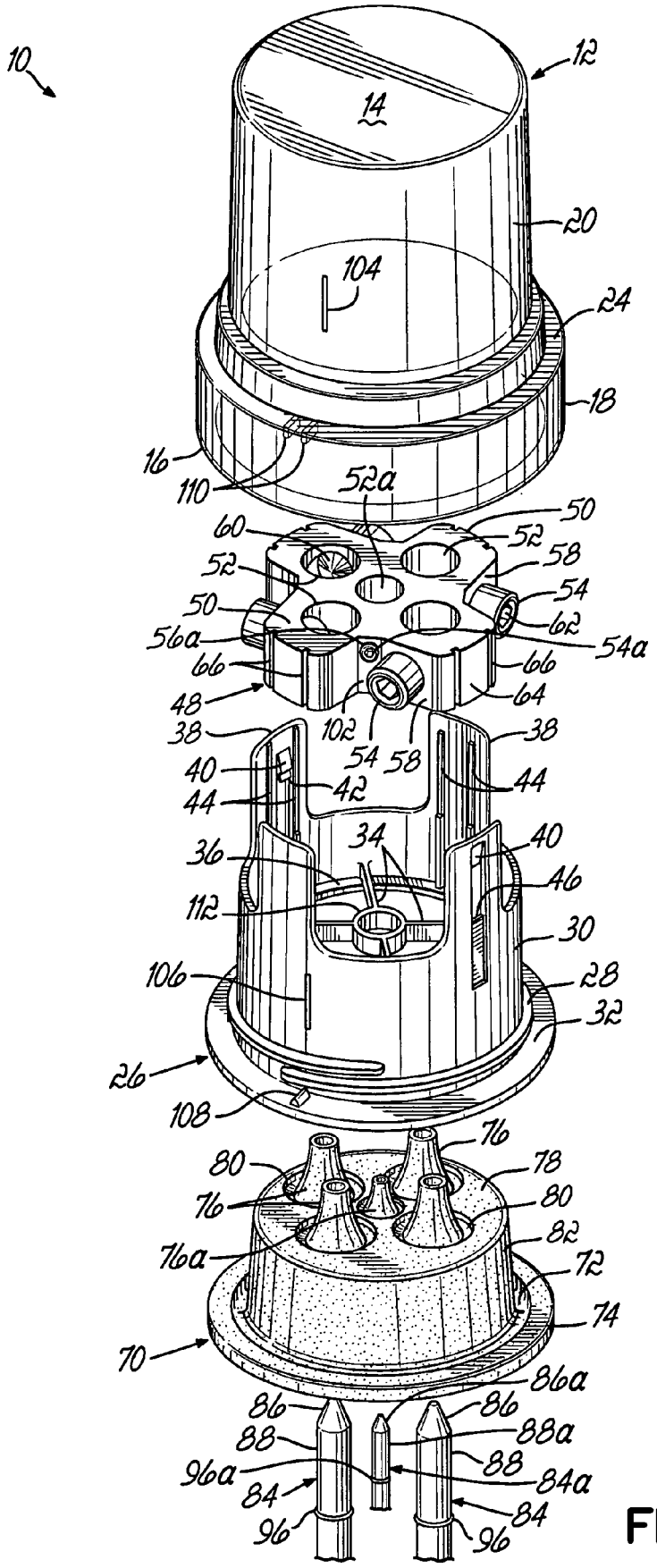
FIG. 5 is an exploded perspective view of the components of an alternative embodiment of the submersible electrical connector.

Referring to FIG. 5, an alternative embodiment of the electrical connector assembly 10 according to this invention is shown with the same or similar features common to the embodiment shown in FIGS. 1–4 carrying the same reference numerals in FIG. 5. The assembly of FIG. 5 includes a central street light fitting so that one of the main seal ducts 76 and associated apertures 52 in the connector plate 48 does not need to be utilized for a street light connection to be added to the connector assembly 10. Specifically, the seal member 70 includes a centrally located seal duct 76*a*, somewhat smaller than the other seal ducts 76. The central seal duct 76*a* is aligned with a centrally located aperture 52*a* in the connector plate 48 when the connector 10 is assembled. A set screw 54*a* is seated within a threaded hole 56*a* in communication with the central aperture 52*a*. A land 102 is formed at the root of at least one of the lobes 50 to provide for access to the set screw 54*a*.

A reduced size wire way guide plug 84*a* is provided with the assembly 10 of FIG. 5 and is initially seated within the central seal duct 76*a*. The wire way guide plug 84*a* has a missile shaped configuration with a conical blunt upper tip 86*a*, an outwardly flared body 88*a* and a ring detent 96*a*. The seal duct 76*a*, aperture 52*a*, set screw 54*a* and wire way guide plug 84*a* function substantially the same as the corresponding elements, although they are sized and configured for a reduced diameter conductor (not shown), typically a street light conductor or the like. A port hole 112 at the intersection of the ribs 34 is provided to allow passage through the seal body 26 for the street light conductor and the wire way guide plug 84*a*.

The seal member 26 and enclosure 12 of the assembly 10 in FIG. 5 also includes a visual seal locator which is corresponding marks 104, 106 molded into the enclosure 12 and sidewall 30 of the seal body 26, respectively. These marks 104, 106 will align with one another to provide the technician a visual indication that the enclosure 12 and seal member 26 are properly mated together and that the compression seal body 70 is seated properly. Additionally, a single detent 108 is formed on the flange 32 of the seal body 26 which will seat between a pair of spaced detents 110 on the shoulder 24 of the enclosure 12 so that the enclosure 12 does not back off or become unintentionally unscrewed from the seal body 26.

As a result, the electrical connector 10 of this invention is submersible when properly assembled. Moreover, since the enclosure 12 is transparent, the metal connector plate 48 to stripped metal conductor 94 connection can be visually inspected and verified without disassembly of the connector 10. The electrical connector assembly 10 is simple for technicians to understand, easy and efficient to install and allows easy inspection and eliminates the opportunity for human error associated with many known connectors.

Moreover, the wire way guide plugs 84, 84*a* prevent contaminates from entering into the sealed region of the connector plate 48. The wire way guide plugs 84, 84*a* are seated within the seal ducts 76, 76*a* and maintain the seal ducts 76, 76*a* in a ready-to-use state for subsequent conductor 94 installation. Moreover, the wire way guide plugs 84, 84*a* conceal and guide the bare metal end 92 of the stranded conductors 94 through the seal ducts 76, 76*a* and into position in the connector plate 48 thereby avoiding splayed strands 100 of the conductor 94 during installation and assembly. The wire way guide plugs 84, 84*a* prevent damage to the seal member 70 and the associated seal ducts 76, 76*a* during conductor 94 entry by preventing the sharp strands 100 from cutting the annular, internal, seal ducts 76, 76*a*. The conductor strands 100 are captured in the wire way guide plug 84 during insertion. The integral and robust seal member 70 limits points of entry into the assembly for contaminates including fluid, water and other sources of contamination.

While four and five conductor configurations are illustrated, other configurations, sizes and designs of connector assembly 10 and/or conductor sizes and combinations are readily envisioned within the scope of this invention. Importantly, during the installation assembly procedure, no cutting of the components is required once the sheath 98 from the conductors 94 is removed. Moreover, the circular configuration of the seal between the seal member 70 and the enclosure 12 minimizes stress on the seal joint thereby extending the service life of the assembly 10 by avoiding stress concentration regions for the seal inner face.

The connector assembly 10 of this invention, with wire way guide plugs 84, 84*a* in place, is capable of withstanding internal pressure without the wire way guide plugs 84, 84*a* popping out of the respective seal ducts 76, 76*a*. Such a benefit is realized when an open-ended conductor 94 is run from the top of a utility pole down to an underground hand hole or the like. The conductor stranding allows water infiltration and a pressure head between the open end 92 of the conductor 94 and the connector assembly 10. Advantageously, it has been determined that such a pressure head does not pop out the wire way guide plugs 84, 84*a* from the seal ducts 76, 76*a* or introduce a leak into the assembly 10.

Although the invention is described in connection with certain embodiments, the invention is not limited to practice in any one specific type of electrical connector. The principles of the invention can be used with a wide variety of electrical connectors. The description of the invention is intended to cover all alternatives, modifications, and equivalent arrangements as may be included within the spirit and scope of the invention as defined by the appended claims. In particular, those skilled in the art will recognize that the components of the invention described herein could be arranged in multiple different ways.

The electrical connectors 10 of the invention may be constructed in accordance with American National Standards Institute (ANSI) or Underwriters Laboratories standards (UL), if it is contemplated that the invention will be used in the United States of America. Other standards are applicable in other countries, such as standards promulgated by the Canadian Standards Association (CSA). The features of the electrical connector 10 may be scaled in size to correlate with a range of conductor gauges being secured.

While the present invention has been illustrated by a description of various embodiments and while these embodiments have been described in considerable detail, it is not the intention of the inventor to restrict or in any way limit the scope of the appended claims to such detail. Additional advantages and modifications will readily appear to those skilled in the art. The invention in its broader aspects is therefore not limited to the specific details, representative apparatus, and illustrative examples shown and described. Accordingly, departures may be made from such details without departing from the spirit of scope of the inventor's general inventive concept. The scope of the invention itself should only be defined by the appended claims, wherein we claim.

The invention claimed is:

1. An electrical connector assembly comprising:

a metal connector plate;

a plurality of apertures in the connector plate;

a plurality of fasteners mounted in the connector plate, each fastener adapted to couple a conductor inserted into the associated aperture to the connector plate;

an enclosure assembly adapted to selectively surround the connector plate and portions of the conductors coupled thereto;

a plurality of ducts in the enclosure assembly, each duct being associated with one of the apertures in the connector plate and adapted to form a seal around a conductor inserted through the duct; and at least one wire way guide plug adapted to be inserted into one of the ducts to seal the associated duct in the absence of a conductor in the associated duct;

wherein the at least one wire way guide plug is adapted to receive a terminal end of a conductor therein to guide the conductor through the associated duct prior to coupling to the connector plate.

2. The electrical connector assembly of claim 1 wherein the at least one wire way guide plug projects into the aperture in the connector plate associated with the respective duct.

3. The electrical connector assembly of claim 1 further comprising:

a detent on the at least one wire way guide plug to inhibit removal of the wire plug from the enclosure in a retrograde direction.

4. The electrical connector assembly of claim 1 wherein at least a portion of the enclosure assembly is substantially transparent to permit visual inspection of the conductors coupled to the connector plate therein.

5. The electrical connector assembly of claim 1 further comprising a plurality of the wire way guide plugs, each being associated with one of the ducts.

6. The electrical connector assembly of claim 1 wherein each wire way guide plug is generally missile-shaped with a tubular sidewall extending between a blunt closed tip and an open ended base adapted to receive the terminal end of the conductor inserted axially through the open ended base toward the blunt closed tip.

7. The electrical connector assembly of claim 1 wherein each fastener is oriented non-radially relative to the center of the connector plate.

8. The electrical connector assembly of claim 1 wherein each fastener is within a generally circular periphery circumscribed about the connector plate so as to avoid interference with the enclosure assembly.

9. The electrical connector assembly of claim 1 wherein the connector plate is generally cruciform-shaped.

10. The electrical connector assembly of claim 1 wherein each duct is adapted to form a seal around a range of conductor sizes without cutting the duct.

11. The electrical connector assembly of claim 1 wherein each fastener is a set screw.

12. The electrical connector assembly of claim 1 wherein each fastener is a set screw.

13. The electrical connector assembly of claim 1 wherein the connector plate is generally cruciform-shaped with the apertures spaced radially from a center of the connector plate.

14. The electrical connector assembly of claim 13 wherein each fastener is oriented non-radially relative to the center of the connector plate.

15. The electrical connector assembly of claim 1 wherein the enclosure assembly further comprises:

a cup-shaped enclosure having an open end; and a seal assembly adapted to be inserted into the open end of the enclosure and releasably coupled thereto.

16. The electrical connector assembly of claim 15 wherein the seal assembly further comprises:

a seal body adapted to support the connector plate; and a seal member adapted to mate with the seal body and provide a fluid-tight connection to the enclosure, the plurality of ducts being formed in the seal member.

17. The electrical connector assembly of claim 16 further comprising:

a plurality of posts projecting from the seal body to support the connector plate.

18. The electrical connector assembly of claim 1 further comprising:

a plurality of posts projecting from the enclosure assembly to support the connector plate within the enclosure assembly.

19. The electrical connector assembly of claim 18 wherein the enclosure assembly further comprises:

a cup-shaped enclosure having an open end; and a seal assembly adapted to be inserted into the open end of the enclosure and releasably coupled thereto;

wherein the posts project from the seal assembly.

20. The electrical connector assembly of claim 19 wherein the seal assembly further comprises:

a seal body, the posts projecting from the seal body to support the connector plate; and a seal member adapted to mate with the seal body and provide a fluid-tight connection to the enclosure, the plurality of ducts being formed in the seal member.

21. An electrical connector assembly comprising:

a metal connector plate;

a plurality of apertures in the connector plate;

a plurality of set screws mounted in the connector plate, each set screw adapted to couple a conductor inserted into the associated aperture to the connector plate;

an enclosure assembly adapted to selectively surround the connector plate and portions of the conductors coupled thereto;

wherein at least a portion of the enclosure assembly is substantially transparent to permit visual inspection of the conductors coupled to the connector plate therein;

a plurality of ducts in the enclosure assembly, each duct being associated with one of the apertures in the connector plate and adapted to form a seal around a conductor inserted through the duct;

a plurality of wire way guide plugs each adapted to be inserted into one of the ducts to seal the associated duct in the absence of a conductor in the associated duct, each wire way guide plug projecting into the aperture in the connector plate associated with the respective duct;

wherein the at least one wire way guide plug is adapted to receive a terminal end of a conductor therein to guide the conductor through the associated duct prior to coupling to the connector plate;

a detent on the at least one wire way guide plug to inhibit removal of the wire plug from the enclosure in a retrograde direction.

22. The electrical connector assembly of claim 21 wherein each wire way guide plug is generally missile-shaped with a tubular sidewall extending between a blunt closed tip and an open ended base adapted to receive the terminal end of the conductor inserted axially through the open ended base toward the blunt closed tip.

23. The electrical connector assembly of claim 21 wherein the enclosure assembly further comprises:

a cup-shaped enclosure having an open end;

a seal body adapted to support the connector plate; and a seal member adapted to mate with the seal body and provide a fluid-tight connection to the open end of the enclosure, the plurality of ducts being formed in the seal member.

24. The electrical connector assembly of claim 23 further comprising:

a plurality of posts projecting from the seal body to support the connector plate.

25. The electrical connector assembly of claim 21 wherein the connector plate is generally cruciform-shaped with the apertures spaced radially from a center of the connector plate.

26. The electrical connector assembly of claim 25 wherein each set screw is oriented non-radially relative to the center of the connector plate.

27. A method of making a submersible electrical connection among a plurality of conductors, the method comprising the steps of:

inserting a plurality of wire way guide plugs into a plurality of ducts in an enclosure assembly, each wire way guide plug sealing the associated duct;

inserting a terminal end of a conductor into one of the wire way guide plugs;

pushing the conductor and associated wire way guide plug through the associated duct and through an aperture in a connector plate adapted to be mounted within the enclosure assembly;

removing the associated wire way guide plug from the conductor; and securing the conductor to the connector plate and thereby forming an electrical connection between the conductor and the connector plate.

28. The method of claim 27 further comprising:

discarding the wire way guide plug after the removing step.

29. The method of claim 27 further comprising:

reusing the wire way guide plug after the removing step.

30. The method of claim 27 further comprising:

assembling a cup shaped enclosure with a seal assembly to form the enclosure assembly.

31. The method of claim 27 further comprising:

juxtaposing a detent on the wire way guide plug to the associated duct the thereby inhibit retrograde movement of the wire way guide plug relative to the duct.

32. The method of claim 27 further comprising:

forming a seal around the conductor with the duct after the pushing step.

33. The method of claim 32 wherein the sealing step is accomplished without cutting the duct.

34. The method of claim 33 wherein the sealing step is accomplished for a range of conductor sizes.

* * * * *